US009475675B2

(12) United States Patent
Kawakami et al.

(10) Patent No.: US 9,475,675 B2
(45) Date of Patent: Oct. 25, 2016

(54) ELEVATOR AND ELEVATOR REFURBISHING METHOD

(75) Inventors: Shigenobu Kawakami, Tokyo (JP); Takao Nishida, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 14/396,940

(22) PCT Filed: Jun. 18, 2012

(86) PCT No.: PCT/JP2012/065495

§ 371 (c)(1),
(2), (4) Date: Oct. 24, 2014

(87) PCT Pub. No.: WO2013/190615

PCT Pub. Date: Dec. 27, 2013

(65) Prior Publication Data

US 2015/0107940 A1 Apr. 23, 2015

(51) Int. Cl.

*B66B 11/00* (2006.01)
*B66B 9/00* (2006.01)
*B66B 19/00* (2006.01)

(52) U.S. Cl.

CPC ..... *B66B 11/008* (2013.01); *B66B 9/00* (2013.01); *B66B 19/007* (2013.01); *Y10T 29/49718* (2015.01)

(58) Field of Classification Search

CPC ..... B66B 11/008; B66B 11/004; B66B 11/0045; B66B 9/00; B66B 19/007
USPC ..... 187/266
See application file for complete search history.

(56) References Cited

U.S. PATENT DOCUMENTS 4,600,086 A * 7/1986 Yamasaki ..... B66B 11/06 187/262
5,361,873 A * 11/1994 de Jong ..... B66B 15/04 187/264

(Continued)

FOREIGN PATENT DOCUMENTS

EP 2082983 A1 7/2009
EP 1641701 3/2012

(Continued)

OTHER PUBLICATIONS

International Search Report issued Sep. 4, 2012 in PCT/JP2012/065495 filed Jun. 18, 2012.

*Primary Examiner* — Michael Riegelman
(74) *Attorney, Agent, or Firm* — Oblon, McClelland, Maier & Neustadt, L.L.P

(57) ABSTRACT

A car and a counterweight are suspended by a main rope that is wound onto a driving sheave, a car suspending sheave, and a counterweight suspending sheave. A first main rope portion between the driving sheave and the car suspending sheave and a second main rope portion between the car suspending sheave and the car-side rope fastener portion are passed through a common car-side penetrating aperture so as to cross each other when viewed in an axial direction of the driving sheave. A third main rope portion between the driving sheave and the counterweight suspending sheave and a fourth main rope portion the counterweight suspending sheave and the counterweight-side rope fastener portion are passed through a common counterweight-side penetrating aperture that is disposed on the machine room floor so as to cross each other when viewed in the axial direction of the driving sheave.

5 Claims, 5 Drawing Sheets

(56) References Cited

U.S. PATENT DOCUMENTS 5,823,298 A * 10/1998 Aulanko ..... B66B 11/08 187/266
5,906,251 A * 5/1999 Aulanko ..... B66B 11/0045 187/254
6,193,016 B1 * 2/2001 Hollowell ..... B66B 7/062 187/250
8,205,720 B2 * 6/2012 Barneman ..... B66B 19/02 187/266
2002/0040830 A1 * 4/2002 Hamaguchi ..... B66B 11/008 187/266
2003/0159891 A1 * 8/2003 Ach ..... B66B 11/008 187/266
2003/0188930 A1 * 10/2003 Lauch ..... B66B 11/008 187/264
2004/0007428 A1 * 1/2004 Teramoto ..... B66B 11/004 187/249
2005/0178621 A1 * 8/2005 Kawasaki ..... B66B 11/004 187/254
2007/0017751 A1 * 1/2007 Liebetrau ..... B66B 19/007 187/266
2011/0315487 A1 * 12/2011 Fargo ..... B66B 11/0484 187/258
2012/0217101 A1 * 8/2012 Peacock ..... B66B 11/0045 187/414
2015/0210509 A1 * 7/2015 Talonen ..... B66B 7/06 187/258

FOREIGN PATENT DOCUMENTS

JP 2007-514622 6/2007
WO 2004/106212 A1 12/2004

* cited by examiner

ELEVATOR AND ELEVATOR REFURBISHING METHOD

TECHNICAL FIELD

The present invention relates to an elevator and an elevator refurbishing method in which a car and a counterweight are suspended by a main rope that is wound onto a car suspending sheave that is disposed on the car and a counterweight suspending sheave that is disposed on the counterweight.

BACKGROUND ART

Conventionally, in order to enable size reductions in hoisting machines, elevator refurbishing methods have been proposed in which elevators in which a suspension method of a car and a counterweight by a main rope is one-to-one (1:1) are modified into elevators in which a suspension method of a car and a counterweight by a main rope is four-to-one (4:1). In the refurbished elevators, car suspending sheaves are disposed on the car, counterweight suspending sheaves are disposed on the counterweight, and a hoisting machine and two direction-changing pulleys are also installed inside a machine room that is positioned in an upper portion of a hoistway. The car and the counterweight in the refurbished elevators are suspended inside the hoistway by a main rope that is wound onto a driving sheave of the hoisting machine, the two direction-changing pulleys, the car suspending sheaves, and the counterweight suspending sheaves. In the refurbished elevators, portions of the main ropes from the driving sheave to the car suspending sheaves and portions of the main ropes from the car suspending sheaves to the direction-changing pulleys are passed through common penetrating apertures that are disposed on a floor of the machine room (see Patent Literature 1 and 2, for example).

CITATION LIST

Patent Literature

[Patent Literature 1]
Japanese Patent Publication No. 2007-514622 (Gazette)
[Patent Literature 2]
Japanese Patent Publication No. 2007-514623 (Gazette)

SUMMARY OF THE INVENTION

Problem to be Solved by the Invention

However, in conventional refurbished elevators, because the portions of the main ropes from the driving sheave are wound onto the car suspending sheave from a side that is horizontally close to the driving sheave, if the portions of the main ropes from the driving sheave to the car suspending sheave and the portions of the main ropes from the car suspending sheave to the direction-changing pulley are passed through a common penetrating aperture, the position of the direction-changing pulley in the machine room is close to the position of the hoisting machine, and the direction-changing pulley interferes with the hoisting machine. Conversely, if the position of the direction-changing pulley is separated horizontally from the position of the hoisting machine in order to avoid interference between the hoisting machine and the direction-changing pulley, the distance between the portions of the main ropes that are passed through the common penetrating aperture is increased, making it necessary to perform construction work to enlarge the penetrating apertures that are disposed in the machine room. Thus, the elevator refurbishing work becomes time-consuming.

The present invention aims to solve the above problems and an object of the present invention is to provide an elevator and an elevator refurbishing method that can facilitate installation work.

Means for Solving the Problem

In order to achieve the above object, according to one aspect of the present invention, there is provided an elevator including: a car that can be raised and lowered inside a hoistway; a car suspending sheave that is disposed on an upper portion of the car; a counterweight that can be raised and lowered inside the hoistway; a counterweight suspending sheave that is disposed on an upper portion of the counterweight; a driving apparatus that includes a driving sheave, that is disposed inside a machine room that is positioned in an upper portion of the hoistway, and that generates a driving force that raises and lowers the car and the counterweight; and a main rope that is connected to each of a car-side rope fastener portion and a counterweight-side rope fastener portion that are disposed inside the machine room, and that suspends the car and the counterweight by being wound onto the driving sheave, the car suspending sheave, and the counterweight suspending sheave, wherein: a portion of the main rope that is directed from the driving sheave to the car-side rope fastener portion is wound onto the car suspending sheave from a side that is horizontally further away from the driving sheave than the car suspending sheave; a portion of the main rope that is directed from the driving sheave to the counterweight-side rope fastener portion is wound onto the counterweight suspending sheave from a side that is horizontally further away from the driving sheave than the counterweight suspending sheave; the main rope includes: a first main rope portion that is positioned between the driving sheave and the car suspending sheave; a second main rope portion that is positioned between the car suspending sheave and the car-side rope fastener portion; a third main rope portion that is positioned between the driving sheave and the counterweight suspending sheave; and a fourth main rope portion that is positioned between the counterweight suspending sheave and the counterweight-side rope fastener portion; the first main rope portion and the second main rope portion are passed through a common car-side penetrating aperture that is disposed on a machine room floor that forms a partition between the hoistway and the machine room so as to cross each other when viewed in an axial direction of the driving sheave; and the third main rope portion and the fourth main rope portion are passed through a common counterweight-side penetrating aperture that is disposed on the machine room floor so as to cross each other when viewed in the axial direction of the driving sheave.

According to another aspect of the present invention, there is provided an elevator refurbishing method, being an elevator refurbishing method to modify a method for suspending a car and a counterweight by a main rope from one-to-one (1:1) to two-to-one (2:1), including: a car suspending sheave mounting step in which a car suspending sheave is mounted onto an upper portion of the car; a counterweight suspending sheave mounting step in which a counterweight suspending sheave is mounted onto an upper portion of the counterweight; and a suspending step in which the car and the counterweight are suspended by the main rope by connecting the main rope to a car-side rope fastener portion and a counterweight-side rope fastener portion that are disposed inside a machine room that is positioned in an upper portion of a hoistway, and winding the main rope onto a driving sheave of a driving apparatus that is installed inside the machine room, onto the car suspending sheave, and onto the counterweight suspending sheave, wherein: in the suspending step, a portion of the main rope that is directed from the driving sheave to the car-side rope fastener portion is wound onto the car suspending sheave from a side that is horizontally further away from the driving sheave than the car suspending sheave, and a portion of the main rope that is directed from the driving sheave to the counterweight-side rope fastener portion is wound onto the counterweight suspending sheave from a side that is horizontally further away from the driving sheave than the counterweight suspending sheave; the main rope that is disposed in the suspending step includes: a first main rope portion that is positioned between the driving sheave and the car suspending sheave; a second main rope portion that is positioned between the car suspending sheave and the car-side rope fastener portion; a third main rope portion that is positioned between the driving sheave and the counterweight suspending sheave; and a fourth main rope portion that is positioned between the counterweight suspending sheave and the counterweight-side rope fastener portion; the first main rope portion and the second main rope portion are passed through a common car-side penetrating aperture that is disposed on a machine room floor that forms a partition between the hoistway and the machine room so as to cross each other when viewed in an axial direction of the driving sheave; and the third main rope portion and the fourth main rope portion are passed through a common counterweight-side penetrating aperture that is disposed on the machine room floor so as to cross each other when viewed in the axial direction of the driving sheave.

Effects of the Invention

According to an elevator and an elevator refurbishing method according to the present invention, a distance between a first main rope portion and a second main rope portion can be reduced at a position of a car-side penetrating aperture, and a distance between a third main rope portion and a fourth main rope portion can also be reduced at a position of a counterweight-side penetrating aperture while avoiding interference of each of a car-side rope fastener portion and a counterweight-side rope fastener portion with a driving apparatus. Elevator installation work can thereby be facilitated.

DESCRIPTION OF EMBODIMENTS

A preferred embodiment of the present invention will now be explained with reference to the drawings.

Embodiment 1

Figure 1:
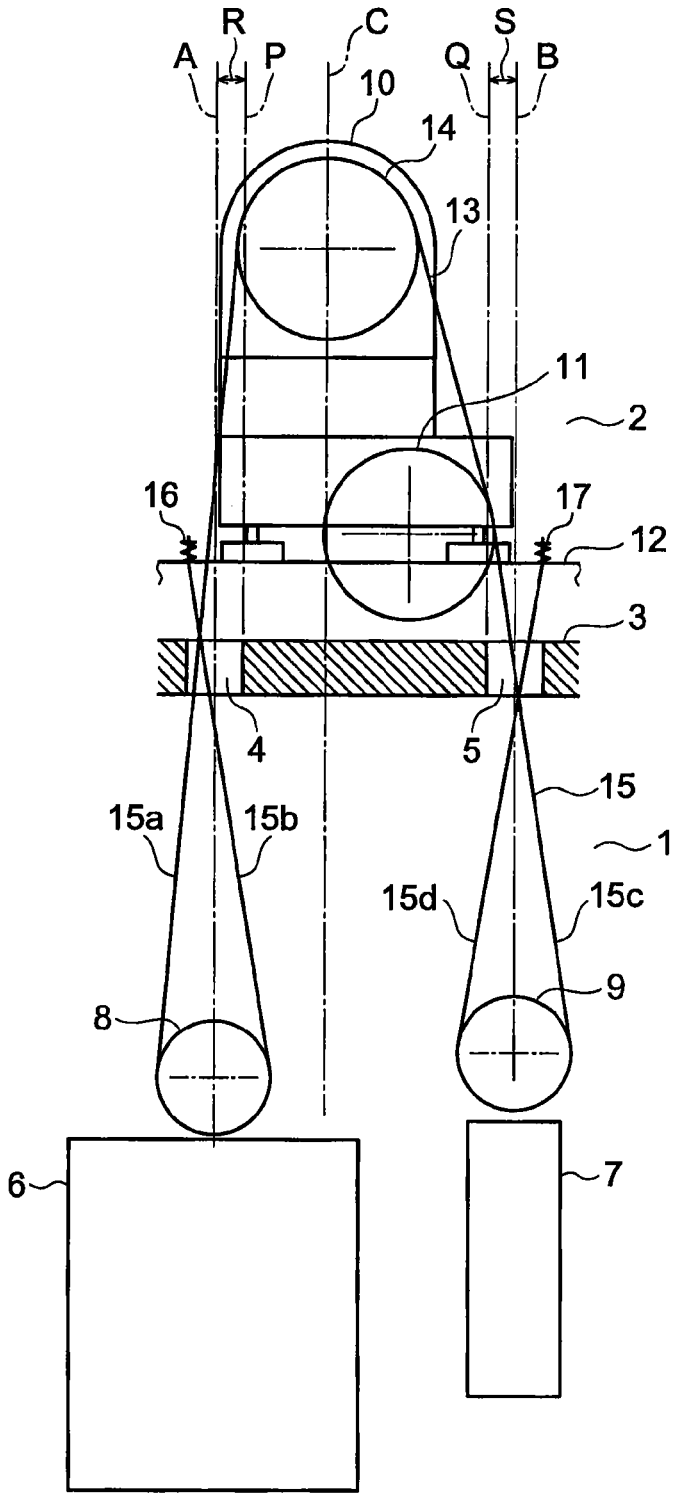
FIG. 1 is a longitudinal cross section that shows an elevator according to Embodiment 1 of the present invention.
Figure 2:
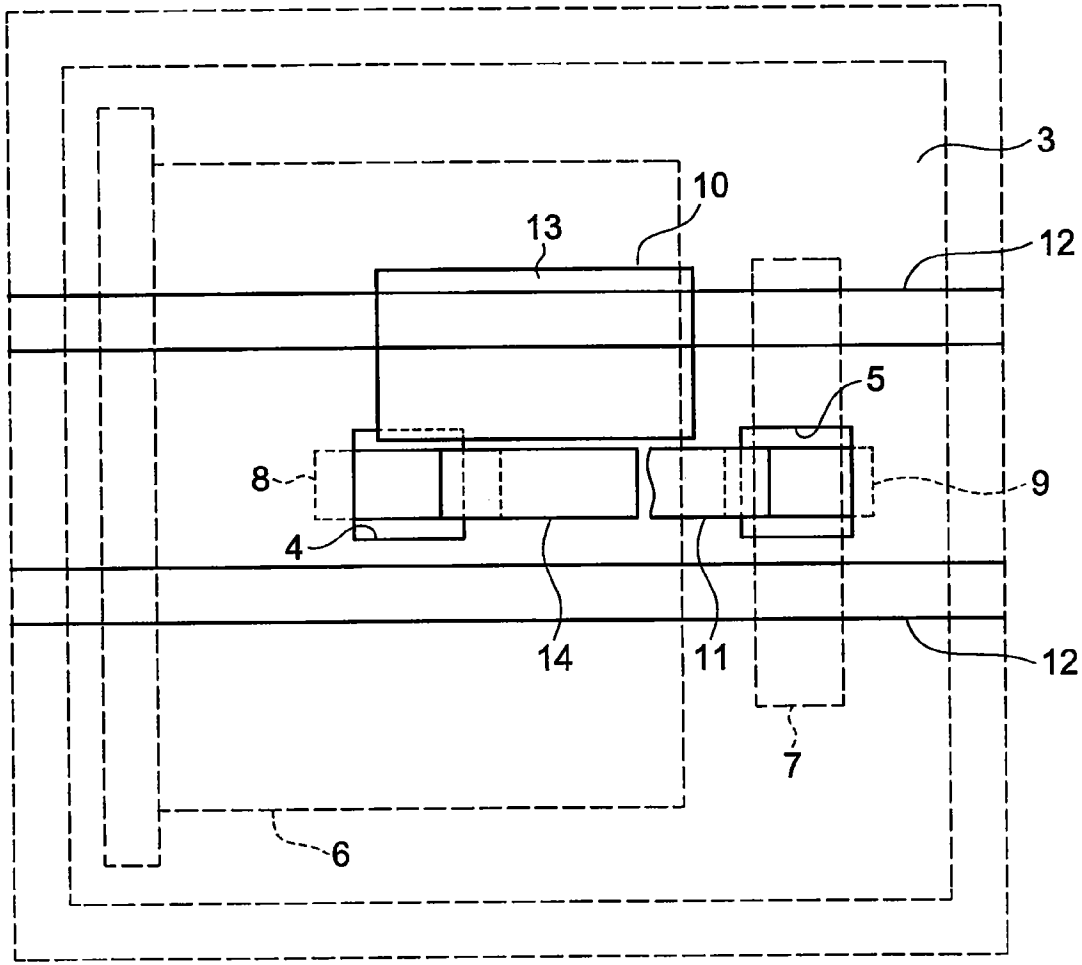
FIG. 2 is a top plan that shows the elevator in FIG. 1.

FIG. 1 is a longitudinal cross section that shows an elevator according to Embodiment 1 of the present invention. FIG. 2 is a top plan that shows the elevator in FIG. 1. In the figure, a machine room 2 is disposed in an upper portion of a hoistway 1. The hoistway 1 and the machine room 2 are partitioned off by a machine room floor (a partitioning wall) 3 that is disposed horizontally. A car-side penetrating aperture 4 and a counterweight-side penetrating aperture 5 that each pass through the machine room floor 3 are disposed on the machine room floor 3 so as to be separated from each other. In this example, as shown in FIG. 2, the car-side penetrating aperture 4, and the counterweight-side penetrating aperture 5 are disposed so as to be separated from each other in a depth direction of the hoistway 1, and the respective cross-sectional shapes of the car-side penetrating aperture 4 and the counterweight-side penetrating aperture 5 are rectangular.

Installed inside the hoistway 1 are: a pair of car guide rails that face each other in a width direction of the hoistway 1; and a pair of counterweight guide rails that also face each other in the width direction of the hoistway 1 (none shown). A car 6 is disposed between the pair of car guide rails so as to be able to be raised and lowered, and a counterweight 7 is disposed between the pair of counterweight guide rails so as to be able to be raised and lowered. The car 6 is guided by the car guide rails while being raised and lowered through the hoistway 1, and the counterweight 7 is guided by the counterweight guide rails while being raised and lowered inside the hoistway 1. As shown in FIG. 2, the car 6 and the counterweight 7 line up inside the hoistway 1 so as to be separated from each other in a depth direction of the hoistway 1 when the hoistway 1 is viewed in a vertical direction.

A car suspending sheave 8 that is rotatable around a rotating shaft that is disposed horizontally is disposed on an upper portion of the car 6. A counterweight suspending sheave 9 that is rotatable around a rotating shaft that is disposed horizontally is disposed on an upper portion of the counterweight 7. In this example, the respective shaft axes of the car suspending sheave 8 and the counterweight suspending sheave 9 are parallel to the width direction of the hoistway 1. Furthermore, in this example, an outside diameter of the car suspending sheave 8 is larger than a width dimension of the car-side penetrating aperture 4, and an outside diameter of the counterweight suspending sheave 9 is larger than a width dimension of the counterweight-side penetrating aperture 5.

A hoisting machine 10 and a deflecting sheave 11 are disposed inside the machine room 2. The hoisting machine 10 and the deflecting sheave 11 are supported by machine bases 12 that are fixed onto the machine room floor 3.

The hoisting machine 10 is a driving apparatus that generates a driving force that raises and lowers the car 6 and the counterweight 7. The hoisting machine 10 includes: a hoisting machine main body (a driving machine main body) 13 that includes a motor; and a driving sheave 14 that is disposed on the hoisting machine main body 13, and that is rotated by a driving force from the hoisting machine main body 13. The driving sheave 14 is rotated around a rotating shaft that is disposed horizontally on the hoisting machine main body 13. In this example, a shaft axis of the driving sheave 14 is aligned with the width direction of the hoistway 1. Consequently, in this example, the respective shaft axes of the car suspending sheave 8 and the counterweight suspending sheave 9 are parallel to the shaft axis of the driving sheave 14.

The deflecting sheave 11 is disposed so as to be separated from the driving sheave 14 at a position that is lower than the driving sheave 14 and that is offset horizontally relative to the driving sheave 14. A shaft axis of the deflecting sheave 11 is parallel to the shaft axis of the driving sheave 14.

The car 6 and the counterweight 7 are suspended inside the hoistway 1 by a plurality of main ropes 15. Ropes or belts, for example, are used as the main ropes 15. Disposed inside the machine room 2 are: a car-side rope fastener portion (a car-side rope hitch) 16 to which first end portions of the main ropes 15 are connected; and a counterweight-side rope fastener portion (a counterweight-side rope hitch) 17 to which second end portions of the main ropes 15 are connected. The car-side rope fastener portion 16 and the counterweight-side rope fastener portion 17 are supported by the machine bases 12.

The main ropes 15 are wound from the first end portions that are connected to the car-side rope fastener portion 16 sequentially onto the car suspending sheave 8, the driving sheave 14, the deflecting sheave 11, and the counterweight suspending sheave 9 to the second end portions that are connected to the counterweight-side rope fastener portion 17. In other words, in an elevator according to the present embodiment, the method for suspending the car 6 and the counterweight 7 by the main ropes 15 is a two-to-one (2:1) roping method. A plurality of grooves into which the main ropes 15 are inserted individually are disposed on respective outer circumferential portions of the driving sheave 14, the deflecting sheave 11, the car suspending sheave 8, and the counterweight suspending sheave 9.

As shown in FIG. 1, the driving sheave 14 and the deflecting sheave 11 are disposed within a range between a vertical line (a car suspending sheave vertical line) A that passes through the shaft axis of the car suspending sheave 8 and a vertical line (a counterweight suspending sheave vertical line) B that passes through the shaft axis of the counterweight suspending sheave 9 when viewed in the axial direction of the driving sheave 14.

In this example, as shown in FIG. 1, a first end portion in a horizontal direction of the driving sheave 14 when viewed in the axial direction of the driving sheave 14 is inserted into a range R between a vertical line (a car-side penetrating aperture vertical line) P that passes through an edge portion of the car-side penetrating aperture 4 near the driving sheave 14 and the car suspending sheave vertical line A. Furthermore, in this example, a first end portion in a horizontal direction of the deflecting sheave 11 when viewed in the axial direction of the driving sheave 14 is inserted into a range S between a vertical line (a counterweight-side penetrating aperture vertical line) Q that passes through an edge portion of the counterweight-side penetrating aperture 5 near the driving sheave 14 and the counterweight suspending sheave vertical line B.

In this example, respective center lines of the car-side penetrating aperture 4 and the car guide rails are aligned with the car suspending sheave vertical line A when viewed in the axial direction of the driving sheave 14, and respective center lines of the counterweight-side penetrating aperture 5 and the counterweight guide rails are aligned with the counterweight suspending sheave vertical line B when viewed in the axial direction of the driving sheave 14.

As shown in FIG. 1, portions of the main ropes 15 that are directed from the driving sheave 14 to the car-side rope fastener portion 16 are wound onto the car suspending sheave 8 from a side that is further away from a vertical line (a driving sheave vertical line) C that passes through the shaft axis of the driving sheave 14 than the car suspending sheave 8 toward a side that is closer thereto than the car suspending sheave 8 when viewed in the axial direction of the driving sheave 14. In other words, the portions of the main ropes 15 that are directed from the driving sheave 14 to the car-side rope fastener portion 16 are wound onto the car suspending sheave 8 from a side that is horizontally further away from the driving sheave 14 than the car suspending sheave 8 toward a side that is horizontally closer to the driving sheave 14 than the car suspending sheave 8.

Portions of the main ropes 15 that are directed from the driving sheave 14 to the counterweight-side rope fastener portion 17 are wound onto the counterweight suspending sheave 9 from a side that is further away from the driving sheave vertical line C than the counterweight suspending sheave 9 toward a side that is closer thereto than the counterweight suspending sheave 9 when viewed in the axial direction of the driving sheave 14. In other words, the portions of the main ropes 15 that are directed from the driving sheave 14 to the counterweight-side rope fastener portion 17 are wound onto the counterweight suspending sheave 9 from a side that is horizontally further away from the driving sheave 14 than the counterweight suspending sheave 9 toward a side that is horizontally closer to the driving sheave 14 than the counterweight suspending sheave 9.

As shown in FIG. 1, the main ropes 15 have: first main rope portions 15*a* that are positioned between the driving sheave 14 and the car suspending sheave 8; second main rope portions 15*b* that are positioned between the car suspending sheave 8 and the car-side rope fastener portion 16; third main rope portions 15*c* that are positioned between the driving sheave 14 and the counterweight suspending sheave 9; and fourth main rope portions 15*d* that are positioned between the counterweight suspending sheave 9 and the counterweight-side rope fastener portion 17. The third main rope portions 15*c* are wound onto the deflecting sheave 11.

The first main rope portions 15*a* and the second main rope portions 15*b* are passed through the common car-side penetrating aperture 4. The first main rope portions 15*a* and the second main rope portions 15*b* cross each other when viewed in the axial direction of the driving sheave 14, as shown in FIG. 1. The car-side rope fastener portion 16 is disposed at a position that is horizontally further away from the driving sheave 14 than the car suspending sheave vertical line A when viewed in the axial direction of the driving sheave 14.

The third main rope portions 15*c* and the fourth main rope portions 15*d* are passed through the common counterweight-side penetrating aperture 5. The third main rope portions 15*c* and the fourth main rope portions 15*d* cross each other when viewed in the axial direction of the driving sheave 14, as shown in FIG. 1. The counterweight-side rope fastener portion 17 is disposed at a position that is horizontally further away from the driving sheave 14 than the counterweight suspending sheave vertical line B when viewed in the axial direction of the driving sheave 14.

In other words, the car-side rope fastener portion 16 and the counterweight-side rope fastener portion 17 are disposed outside a range between the car suspending sheave vertical line A and the counterweight suspending sheave vertical line B when viewed in the axial direction of the driving sheave 14.

Figure 3:
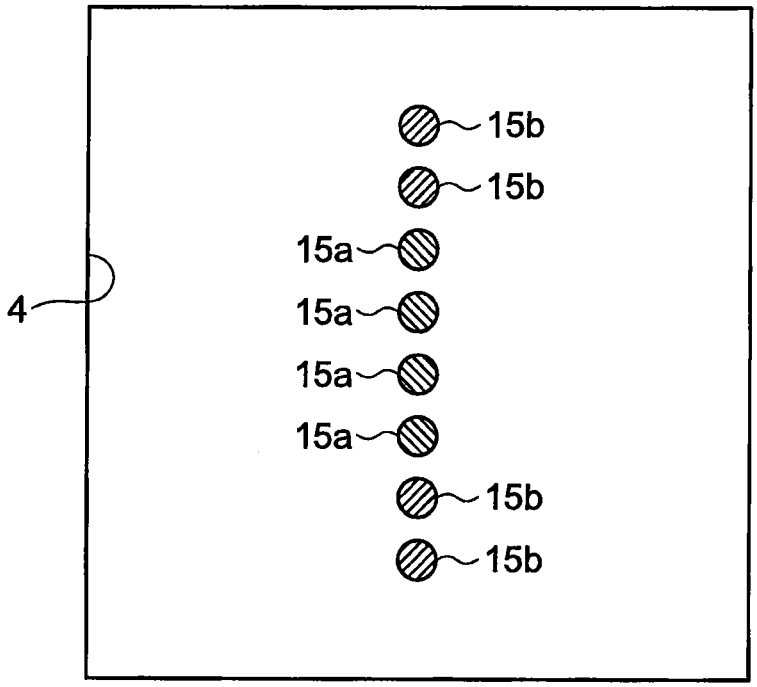
FIG. 3 is a horizontal cross section at a portion where first main rope portions and second main rope portions from FIG. 1 cross.

FIG. 3 is a horizontal cross section at a portion where the first main rope portions 15*a* and the second main rope portions 15*b* from FIG. 1 cross each other. In this example, as shown in FIG. 3, four first main rope portions 15*a* and four second main rope portions 15*b* are passed through the common car-side penetrating aperture 4. The respective first main rope portions 15*a* line up in a thickness direction of the driving sheave 14 (i.e., an axial direction of the driving sheave 14) so as to match a groove pitch of the driving sheave 14. Furthermore, the first main rope portions 15*a* are disposed within a range of the thickness of the driving sheave 14. In contrast to that, the second main rope portions 15*b* are disposed outside a range of the thickness of the driving sheave 14 so as to avoid contact with the first main rope portions 15*b*. In this example, the second main rope portions 15*b* are disposed so as to be distributed at two ends of the range in which the first main rope portions 15*a* are disposed in the direction that the first main rope portions 15*a* line up (the thickness direction of the driving sheave 14). Contact with the first main rope portions 15*a* is avoided by inclining the second main rope portions 15*b* more than the first main rope portions 15*a* in the thickness direction of the driving sheave 14.

In this example, four third main rope portions 15*c* and four fourth main rope portions 15*d* are passed through the common counterweight-side penetrating aperture 5. Although not shown, positional relationships between the third main rope portions 15*c* and the fourth main rope portions 15*d* are similar to positional relationships between the first main rope portions 15*a* and the second main rope portions 15*b*. In other words, the respective third main rope portions 15*c* line up in the thickness direction of the driving sheave 14 so as to match a groove pitch of the driving sheave 14. Furthermore, the third main rope portions 15*c* are disposed within a range of the thickness of the driving sheave 14. In contrast to that, the fourth main rope portions 15*d* are disposed outside a range of the thickness of the driving sheave 14. In this example, the fourth main rope portions 15*d* are disposed so as to be distributed at two ends of the range in which the third main rope portions 15*c* are disposed in the direction that the third main rope portions 15*c* line up (the thickness direction of the driving sheave 14). Contact with the third main rope portions 15*c* is avoided by inclining the fourth main rope portions 15*d* more than the third main rope portions 15*c* in the thickness direction of the driving sheave 14.

In other words, the first main rope portions 15*a* and the third main rope portions 15*c* that extend from the driving sheave 14 are disposed within a range of the thickness of the driving sheave 14, and the second main rope portions 15*b* and the fourth main rope portions 15*d* that are separately connected to the car-side rope fastener portion 16 and the counterweight-side rope fastener portion 17 are disposed outside the range of the thickness of the driving sheave 14.

When the driving sheave 14 is rotated by the driving force from the hoisting machine 10, the first main rope portions 15*a* and the third main rope portions 15*c* move in their respective longitudinal directions. The car 6 and the counterweight 7 are raised and lowered thereby. Here, because the second main rope portions 15*b* and the fourth main rope portions 15*d* are separately connected to the car-side rope fastener portion 16 and the counterweight-side rope fastener portion 17, they will not move in the longitudinal direction of the main ropes 15.

Next, an elevator refurbishing method in which an elevator in which a car 6 and a counterweight 7 are suspended by main ropes in which first end portions are connected to the car 6 and second end portions are connected to the counterweight 7 before refurbishment (i.e., an elevator in which the method for suspending the car 6 and the counterweight 7 by the main ropes is a one-to-one (1:1) roping method) is modified into a refurbished elevator in which the car 6 and the counterweight 7 are suspended by main ropes that are wound onto a car suspending sheave 8 that is disposed on the car 6 and a counterweight suspending sheave 9 that is disposed on the counterweight 7 (i.e., an elevator in which the method for suspending the car 6 and the counterweight 7 by the main ropes is a two-to-one (2:1) roping method) will be explained.

When the refurbishing work to modify the method for suspending the car 6 and the counterweight 7 by the main ropes from one-to-one to two-to-one is performed, the car 6 and the counterweight 7 are first supported by supports to prevent the car 6 and the counterweight 7 from falling. Next, the existing hoisting machine, deflecting sheave, and main ropes from before refurbishment are removed.

Next, a new car suspending sheave 8 is mounted onto an upper portion of the car 6 (a car suspending sheave mounting step), and a new counterweight suspending sheave 9 is also mounted onto an upper portion of the counterweight 7 (a counterweight suspending sheave mounting step). A new hoisting machine 10 and deflecting sheave 11 are also each installed on the machine bases 12 inside the machine room 2 (an equipment installing step).

Next, the main ropes 15 are passed through the existing car-side penetrating aperture 4 and the existing counterweight-side penetrating aperture 5 that are disposed on the machine room floor 3 while winding the main ropes 15 onto the driving sheave 14 of the hoisting machine 10, the deflecting sheave 11, the car suspending sheave 8, and the counterweight suspending sheave 9, and the first end portions and the second end portions of the main ropes 15 are also individually connected to the car-side rope fastener portion 16 and the counterweight-side rope fastener portion 17, which are installed on the machine bases 12 inside the machine room 2.

At this point, as shown in FIG. 1, the portions of the main ropes 15 that are directed from the driving sheave 14 to the car-side rope fastener portion 16 are wound onto the car suspending sheave 8 from a side that is horizontally further away from the driving sheave 14 than the car suspending sheave 8, and the portions of the main ropes 15 that are directed from the driving sheave 14 to the counterweight-side rope fastener portion 17 are wound onto the counterweight suspending sheave 9 from a side that is horizontally further away from the driving sheave 14 than the counterweight suspending sheave 9. Furthermore, the first main rope portions 15*a* and the second main rope portions 15*b* of the main ropes 15 are passed through the common car-side penetrating aperture 4, and the third main rope portions 15*c* and the fourth main rope portions 15*d* of the main ropes 15 are passed through the common counterweight-side penetrating aperture 5. In addition, when the main ropes 15 are viewed in the axial direction of the driving sheave 14, the first main rope portions 15*a* and the second main rope portions 15*b* of the main ropes 15 are crossed, and the third main rope portions 15*c* and the fourth main rope portions 15*d* of the main ropes 15 are also crossed.

Next, the car 6 and the counterweight 7 are suspended by the main ropes 15 by removing the supports that support the car 6 and the counterweight 7 (a suspending step). In this manner, the method for suspending the car 6 and the counterweight 7 by the main ropes is modified from one-to-one to two-to-one.

In an elevator of this kind, because the portions of the main ropes 15 that are directed from the driving sheave 14 to the car-side rope fastener portion 16 are wound onto the car suspending sheave 8 from a side that is horizontally further away from the driving sheave 14 than the car suspending sheave 8, and the portions of the main ropes 15 that are directed from the driving sheave 14 to the counterweight-side rope fastener portion 17 are wound onto the counterweight suspending sheave 9 from a side that is horizontally further away from the driving sheave 14 than the counterweight suspending sheave 9, and the first main rope portions 15*a* and the second main rope portions 15*b* of the main ropes 15 are crossed with each other and the third main rope portions 15*c* and the fourth main rope portions 15*d* of the main ropes 15 are also crossed with each other when the main ropes 15 are viewed in the axial direction of the driving sheave 14, the distance between the first main rope portions 15*a* and the second main rope portions 15*b* can be reduced at the position of the car-side penetrating aperture 4 and the distance between the third main rope portions 15*c* and the fourth main rope portions 15*d* can also be reduced at the position of the counterweight-side penetrating aperture 5 while avoiding interference of each of the car-side rope fastener portion 16 and the counterweight-side rope fastener portion 17 with the hoisting machine 10. Thus, the car-side rope fastener portion 16 and the counterweight-side rope fastener portion 17 can be easily installed, and the operation of passing the first and second main rope portions 15*a* and 15*b* through the common car-side penetrating aperture 4, and the operation of passing the third and fourth main rope portions 15*c* and 15*d* through the common counterweight-side penetrating aperture 5, can also be facilitated. The need to perform construction work to enlarge the car-side penetrating aperture 4 and the counterweight-side penetrating aperture 5, or construction work to add other penetrating apertures to the machine room floor 3, can be reduced, particularly in cases in which the refurbishing work is performed to modify the method for suspending the car 6 and the counterweight 7 by the main ropes 15 from one-to-one to two-to-one. Furthermore, because the method for suspending the car 6 and the counterweight 7 by the main ropes 15 becomes a two-to-one roping method, size reductions can be achieved in the hoisting machine 10, and lifting operations for the hoisting machine 10, etc., can be facilitated. Work space can also be easily secured in the machine room 2, also enabling improvements in workability in the machine room 2 to be achieved. Thus, elevator installation work can be facilitated.

Because the first main rope portions 15*a* are disposed within a range of a thickness of the driving sheave 14 and the second main rope portions 15*b* is disposed outside the range of the thickness of the driving sheave 14 when the car-side penetrating aperture 4 is viewed in a vertical direction, and the third main rope portions 15*c* are disposed within the range of the thickness of the driving sheave 14 and the fourth main rope portions 15*d* are disposed outside the range of the thickness of the driving sheave 14 when the counterweight-side penetrating aperture 5 is viewed in a vertical direction, the first and second main rope portions 15*a* and 15*b* can be crossed with each other and the third and fourth main rope portions 15*c* and 15*d* can be crossed with each other while preventing the first and third main rope portions 15*a* and 15*c*, which move during hoisting of 6 the car and the counterweight 7, from inclining significantly in the thickness direction of the driving sheave 14. Thus, the main ropes 15 can be moved more smoothly relative to the driving sheave 14, the car suspending sheave 8, and the counterweight suspending sheave 9, and movement of the car 6 and the counterweight 7 can be made smoother.

Because the driving sheave 14 is disposed within a range between a car suspending sheave vertical line A and a counterweight suspending sheave vertical line B when viewed in the axial direction of the driving sheave 14, and the car-side rope fastener portion 16 and the counterweight-side rope fastener portion 17 are disposed outside the range between the car suspending sheave vertical line A and the counterweight suspending sheave vertical line B when viewed in the axial direction of the driving sheave 14, interference of each of the car-side rope fastener portion 16 and the counterweight-side rope fastener portion 17 with the hoisting machine 10 can be more reliably prevented.

Because a first end portion in a horizontal direction of the driving sheave 14 when viewed in the axial direction of the driving sheave 14 is inserted into a range R between a car-side penetrating aperture vertical line P and the car suspending sheave vertical line A, the main ropes 15 can be prevented from contacting inner surfaces of the car-side penetrating aperture 4 even if the direction of the first main rope portions 15*a* approaches a vertical direction due to descent of the car 6, or the angle of inclination of the first main rope portions 15*a* is increased due to ascent of the car 6.

Because a first end portion in a horizontal direction of the deflecting sheave 11 when viewed in the axial direction of the driving sheave 14 is inserted into a range S between a counterweight-side penetrating aperture vertical line Q and the counterweight suspending sheave vertical line B, the main ropes 15 can be prevented from contacting inner surfaces of the counterweight-side penetrating aperture 5 even if the direction of the third main rope portions 15*d* approaches a vertical direction due to descent of the counterweight 7, or the angle of inclination of the third main rope portions 15*d* is increased due to ascent of the counterweight 7.

Furthermore, in elevator refurbishing work to modify the method for suspending the car 6 and the counterweight 7 by the main ropes 15 from one-to-one to two-to-one, because the portions of the main ropes 15 that are directed from the driving sheave 14 to the car-side rope fastener portion 16 are wound onto the car suspending sheave 8 from a side that is further away from the driving sheave 14 than the car suspending sheave 8 and the portions of the main ropes 15 that are directed from the driving sheave 14 to the counterweight-side rope fastener portion 17 are wound onto the counterweight suspending sheave 9 from a side that is further away from the driving sheave 14 than the counterweight suspending sheave 9, the distance between the first main rope portions 15*a* and the second main rope portions 15*b* can be reduced at the position of the car-side penetrating aperture 4 and the distance between the third main rope portions 15*c* and the fourth main rope portions 15*d* can also be reduced at the position of the counterweight-side penetrating aperture 5 while avoiding interference of each of the car-side rope fastener portion 16 and the counterweight-side rope fastener portion 17 with the hoisting machine 10. Thus, the car-side rope fastener portion 16 and the counterweight-side rope fastener portion 17 can be easily installed, and the need to perform construction work to enlarge the car-side penetrating aperture 4 and the counterweight-side penetrating aperture 5, or construction work to add other penetrating apertures to the machine room floor 3, can be reduced. Thus, elevator installation work can be facilitated, and elevator refurbishing work can also be facilitated.

Figure 4:
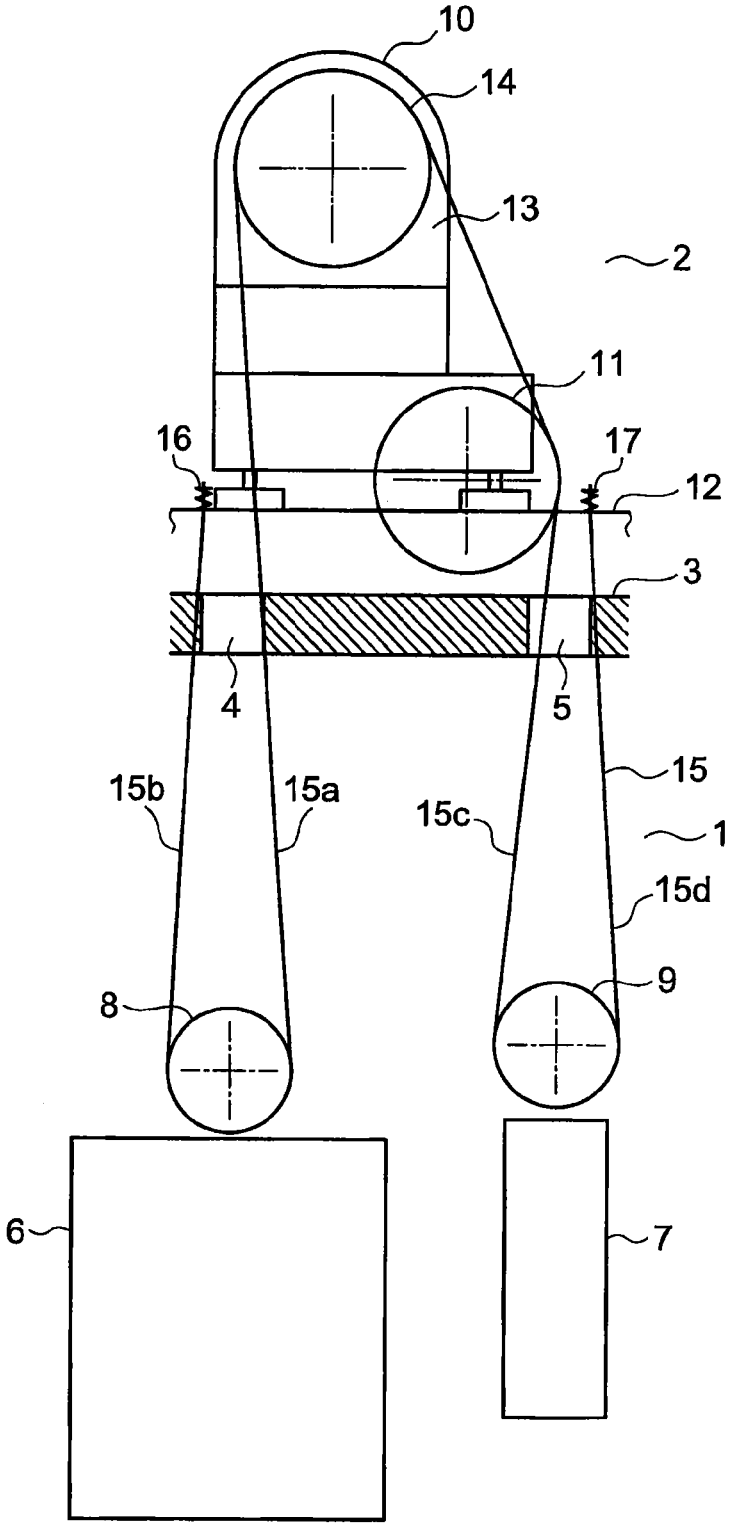
FIG. 4 is a longitudinal cross section that shows an elevator according to Comparative Example 1.
Figure 5:
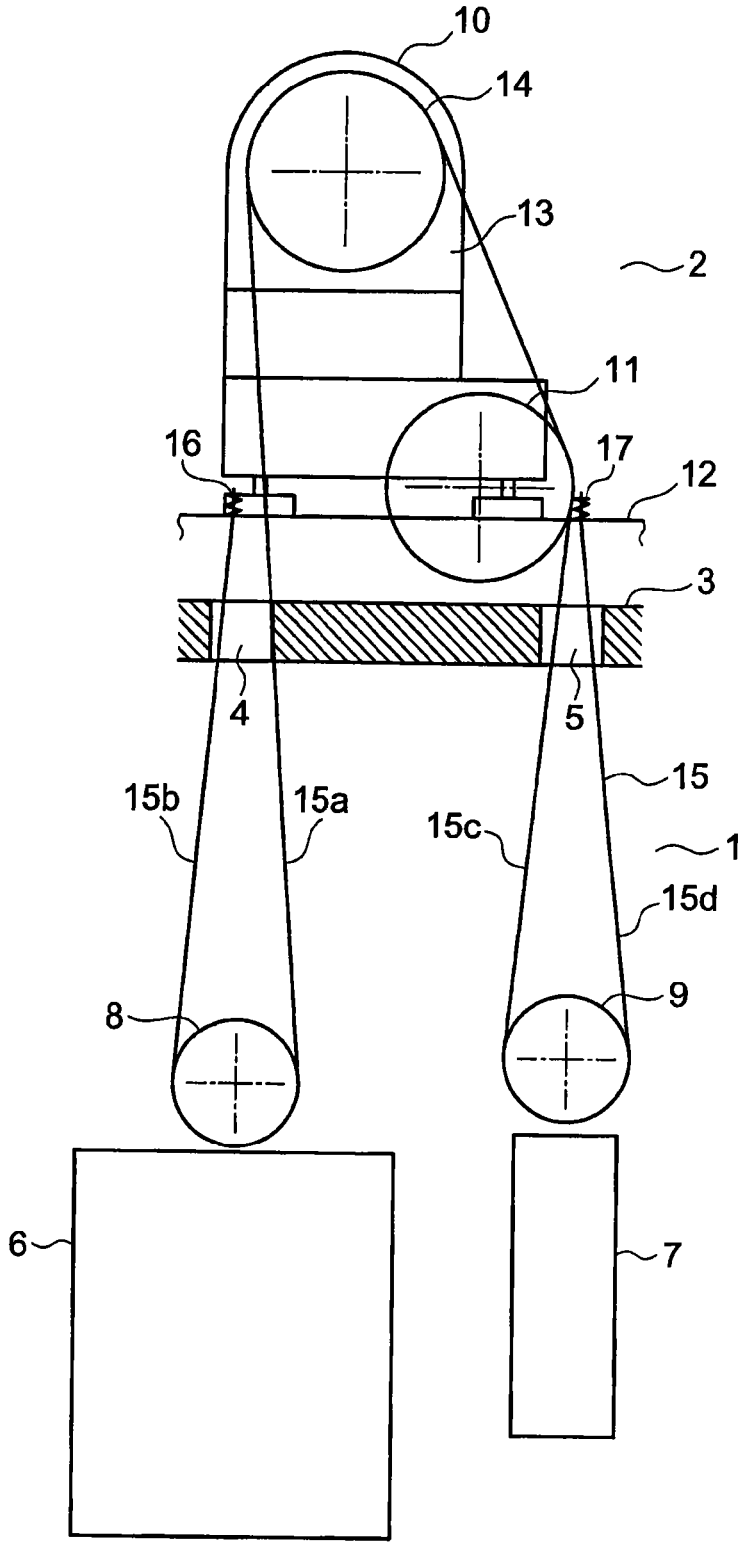
FIG. 5 is a longitudinal cross section that shows an elevator according to Comparative Example 2.

Next, Comparative Examples 1 and 2 will be explained for comparison with the present invention. FIG. 4 is a longitudinal cross section that shows an elevator according to Comparative Example 1. FIG. 5 is a longitudinal cross section that shows an elevator according to Comparative Example 2. In Comparative Examples 1 and 2, portions of the main ropes 15 that are directed from the driving sheave 14 to the car-side rope fastener portion 16 are wound onto the car suspending sheave 8 from a side that is closer to a driving sheave vertical line C than the car suspending sheave 8 when viewed in the axial direction of the driving sheave 14. In Comparative Examples 1 and 2, portions of the main ropes 15 that are directed from the driving sheave 14 to the counterweight-side rope fastener portion 17 are wound onto the counterweight suspending sheave 9 from a side that is closer to the driving sheave vertical line C than the counterweight suspending sheave 9 when viewed in the axial direction of the driving sheave 14. In addition, in Comparative Examples 1 and 2, there are no positions at which the main ropes 15 cross each other when the main ropes 15 are viewed in the axial direction of the driving sheave 14.

In Comparative Example 1, as shown in FIG. 4, the car-side rope fastener portion 16 and the counterweight-side rope fastener portion 17 are each installed so as to avoid interference with the hoisting machine 10. In contrast to that, in Comparative Example 2, as shown in by FIG. 5, the main ropes 15 are disposed so as to avoid interference with each of the car-side penetrating aperture 4 and the counterweight-side penetrating aperture 5.

In Comparative Example 1, as shown in FIG. 4, it can be seen that when the car-side rope fastener portion 16 and the counterweight-side rope fastener portion 17 are each installed so as to avoid interference with the hoisting machine 10, the main ropes 15 interfere with the car-side penetrating aperture 4 and the counterweight-side penetrating aperture 5. In Comparative Example 2, as shown in FIG. 5, it can be seen that when the main ropes 15 are disposed so as to avoid interference with each of the car-side penetrating aperture 4 and the counterweight-side penetrating aperture 5, the car-side rope fastener portion 16 and the counterweight-side rope fastener portion 17 each interfere with the hoisting machine 10.

Moreover, in the above embodiment, the respective shaft axes of the car suspending sheave 8 and the counterweight suspending sheave 9 are parallel to the shaft axis of the driving sheave 14, but at least one of the respective shaft axes of the car suspending sheave 8 and the counterweight suspending sheave 9 may be inclined relative to the shaft axis to the driving sheave 14 when the car suspending sheave 8 and the counterweight suspending sheave 9 are viewed in a vertical direction.

In the above embodiment, a deflecting sheave 11 is disposed inside the machine room 2, but the deflecting sheave 11 may be omitted provided that the main ropes 15 do not interfere with either of the car-side penetrating aperture 4 and the counterweight-side penetrating aperture 5.

In the above embodiment, an outside diameter of the car suspending sheave 8 is greater than a width dimension of the car-side penetrating aperture 4, but the outside diameter of the car suspending sheave 8 may be set to a dimension that is less than or equal to the width dimension of the car-side penetrating aperture 4. In addition, in the above embodiment, an outside diameter of the counterweight suspending sheave 9 is greater than a width dimension of the counterweight-side penetrating aperture 5, but the outside diameter of the counterweight suspending sheave 9 may be set to a dimension that is less than or equal to the width dimension of the counterweight-side penetrating aperture 5.

The invention claimed is:

1. An elevator comprising:

a car that can be vertically raised and lowered inside a hoistway;

a car suspending sheave that is disposed on an upper portion of the car between a top surface of the car and a top surface of the hoistway:

a counterweight that can be raised and lowered inside the hoistway;

a counterweight suspending sheave that is disposed on an upper portion of the counterweight between a top surface of the counterweight and a top surface of the hoistway:

a driving apparatus that includes a driving sheave, that is disposed inside a machine room that is positioned above the hoistway, and that generates a driving force that raises and lowers the car and the counterweight; and a main rope that is connected to each of a car-side rope fastener portion and a counterweight-side rope fastener portion that are disposed inside the machine room, and that suspends the car and the counterweight by being wound onto the driving sheave, the car suspending sheave, and the counterweight suspending sheave, wherein:

a portion of the main rope that is directed from the driving sheave to the car-side rope fastener portion is wound onto the car suspending sheave at a first side of the car suspending sheave, a distance from the side of the car suspending sheave to a vertical line that passes through a shaft axis of the driving sheave is horizontally greater than a distance from a vertical line that passes through a shaft axis of the car suspending sheave to the vertical line passing through axis of the driving sheave;

a portion of the main rope that is directed from the driving sheave to the counterweight-side rope fastener portion is wound onto the counterweight suspending sheave at a first side of the counterweight suspending sheave, a distance from the side of the counterweight suspending sheave to the vertical line passing through the shaft axis of the driving sheave is horizontally greater than a distance from a vertical line that passes through a shaft axis of the counterweight suspending sheave to the vertical line passing through axis of the driving sheave, wherein the horizontal distance is substantially perpendicular to a vertical motion of the car;

the main rope includes: a first main rope portion that is positioned between the driving sheave and the car suspending sheave; a second main rope portion that is positioned between the car suspending sheave and the car-side rope fastener portion; a third main rope portion that is positioned between the driving sheave and the counterweight suspending sheave; and a fourth main rope portion that is positioned between the counterweight suspending sheave and the counterweight-side rope fastener portion;

the first main rope portion and the second main rope portion are passed through a common car-side penetrating aperture that is disposed on a machine room floor that forms a partition between the hoistway and the machine room, the first main rope extending from the driving sheave to the first side of the car suspending sheave and extending across the vertical line passing through the car suspending sheave axis, the second main rope extending from a second side of the car suspending sheave opposite the first side, to the car-side rope fastener portion and extending across the vertical line passing through the car suspending sheave axis, wherein a point of contact between the first main rope and the driving sheave is positioned on a first side of the vertical line extending through the car suspending sheave axis, and an end of the second rope attached to the car-side rope fastener portion is positioned on a second side of the vertical line extending through the car suspending sheave axis which is opposite the first side so that the first main rope and the second main rope cross each other when viewed in a direction perpendicular to the vertical motion of the car; and the third main rope portion and the fourth main rope portion are passed through a common counterweight-side penetrating aperture that is disposed on the machine room floor, the third main rope extending from the driving sheave to the first side of the counterweight suspending sheave and extending across the vertical line passing through the counterweight suspending sheave axis, the fourth main rope extending from a second side of the counterweight suspending sheave opposite the first side, to the counterweight-side rope fastener portion and extending across the vertical line passing through the counterweight suspending sheave axis, wherein a point of contact between the third main rope and the driving sheave is positioned on a first side of the vertical line extending through the counterweight suspending sheave axis, and an end of the fourth rope attached to the counterweight-side rope fastener portion is positioned on a second side of the vertical extending through the counterweight suspending sheave axis which is opposite the first side so that the third main rope and the fourth main rope cross each other when viewed in a direction perpendicular to the vertical motion of the car.

2. The elevator according to claim 1, wherein:

the first main rope portion is disposed within a range of a thickness of the driving sheave, and the second main rope portion is disposed outside the range of the thickness of the driving sheave, when the car-side penetrating aperture is viewed in a vertical direction which is a same direction as the vertical motion of the car; and the third main rope portion is disposed within the range of the thickness of the driving sheave, and the fourth main rope portion is disposed outside the range of the thickness of the driving sheave, when the counterweight-side penetrating aperture is viewed in the vertical direction which is a same direction as the vertical motion of the car.

3. The elevator according to claim 2, wherein:

the driving sheave is disposed within a range between the car suspending sheave vertical line that passes through the shaft axis of the car suspending sheave and the counterweight suspending sheave vertical line that passes through the shaft axis of the counterweight suspending sheave when viewed in the axial direction of the driving sheave, the axial direction of the driving sheave being perpendicular to the vertical motion of the car; and the car-side rope fastener portion and the counterweight-side rope fastener portion are disposed outside the range between the car suspending sheave vertical line and the counterweight suspending sheave vertical line when viewed in the axial direction of the driving sheave.

4. The elevator according to claim 1, wherein:

the driving sheave is disposed within a range between the car suspending sheave vertical line that passes through the shaft axis of the car suspending sheave and the counterweight suspending sheave vertical line that passes through the shaft axis of the counterweight suspending sheave, when viewed in the axial direction of the driving sheave, the axial direction of the driving sheave being perpendicular to the vertical motion of the car; and the car-side rope fastener portion and the counterweight-side rope fastener portion are disposed outside the range between the car suspending sheave vertical line and the counterweight suspending sheave vertical line when viewed in the axial direction of the driving sheave.

5. An elevator refurbishing method, being an elevator refurbishing method to modify a method for suspending a car and a counterweight by a main rope from one-to-one (1:1) to two-to-one (2:1), comprising:

a car suspending sheave mounting step in which a car suspending sheave is mounted onto an upper portion of the car between a top surface of the car and a top surface of a hoistway;

a counterweight suspending sheave mounting step in which a counterweight suspending sheave is mounted onto an upper portion of the counterweight between a top surface of the counterweight and a top surface of the hoistway; and a suspending step in which the car and the counterweight are suspended by the main rope by connecting the main rope to a car-side rope fastener portion and a counterweight-side rope fastener portion that are disposed inside a machine room that is positioned above the hoistway, and winding the main rope onto a driving sheave of a driving apparatus that is installed inside the machine room, onto the car suspending sheave, and onto the counterweight suspending sheave, wherein:

in the suspending step, a portion of the main rope that is directed from the driving sheave to the car-side rope fastener portion is wound onto the car suspending sheave at a side of the car suspending sheave, a distance from the side of the car suspending sheave to a vertical line that passes through a shaft axis of the driving sheave is horizontally greater than a distance from a vertical line that passes through a shaft axis of the car suspending sheave to the vertical line passing through axis of the driving sheave, and a portion of the main rope that is directed from the driving sheave to the counterweight-side rope fastener portion is wound onto the counterweight suspending sheave at a side of the counterweight suspending sheave, a distance from the side of the counterweight suspending sheave to the vertical line passing through the shaft axis of the driving sheave is horizontally greater than a distance from a vertical line that passes through a shaft axis of the counterweight suspending sheave to the vertical line passing through axis of the driving sheave, wherein the horizontal distance is substantially perpendicular to a vertical motion of the car;

the main rope that is disposed in the suspending step includes: a first main rope portion that is positioned between the driving sheave and the car suspending sheave; a second main rope portion that is positioned between the car suspending sheave and the car-side rope fastener portion; a third main rope portion that is positioned between the driving sheave and the counterweight suspending sheave; and a fourth main rope portion that is positioned between the counterweight suspending sheave and the counterweight-side rope fastener portion;

the first main rope portion and the second main rope portion are passed through a common car-side penetrating aperture that is disposed on a machine room floor that forms a partition between the hoistway and the machine room, the first main rope extending from the driving sheave to the first side of the car suspending sheave and extending across the vertical line passing through the car suspending sheave axis, the second main rope extending from a second side of the car suspending sheave opposite the first side, to the car-side rope fastener portion and extending across the vertical line passing through the car suspending sheave axis, wherein a point f contact between the first main rope and the driving sheave is positioned on a first side of the vertical line extending through the car suspending sheave axis, and an end of the second rope attached to the car-side rope fastener portion is positioned on a second side of the vertical line extending through the car suspending sheave axis which is opposite the first side so that the first main rope and the second main rope cross each other when viewed in a direction perpendicular to the vertical motion of the car; and the third main rope portion and the fourth main rope portion are passed through a common counterweight-side penetrating aperture that is disposed on the machine room floor, the third main rope extending from the driving sheave to the first side of the counterweight suspending sheave and extending across the vertical line passing through the counterweight suspending sheave axis, the fourth main rope extending from a second side of the counterweight suspending sheave opposite the first side, to the counterweight-side rope fastener portion and extending across the vertical line passing through the counterweight suspending sheave axis, wherein a point of contact between the third main rope and the driving sheave is positioned on a first side of the vertical line extending through the counterweight suspending sheave axis, and an end of the fourth rope attached to the counterweight-side rope fastener portion is positioned on a second side of the vertical line extending through the counterweight suspending sheave axis which is opposite the first side so that the third main rope and the fourth main rope cross each other when viewed in a direction perpendicular to the vertical motion of the car.

* * * * *